United States Patent [19]

Avara

[11] 4,035,936

[45] July 19, 1977

[54] EXCAVATOR ATTACHMENT FOR BOOM STRUCTURE

[76] Inventor: Teddy Walter Avara, 101 McRaven St., Clinton, Miss. 39056

[21] Appl. No.: 701,681

[22] Filed: July 1, 1976

[51] Int. Cl.[2] ..... E02F 3/46

[52] U.S. Cl. ..... 37/116; 37/103; 214/138 R; 37/117.5

[58] Field of Search ..... 37/117.5, 103, 115, 37/116; 214/138 R, 131 R, 131 A, 145 R, 145 A, 916.5

[56] References Cited

U.S. PATENT DOCUMENTS

| | | | |
|---|---|---|---|
| 3,049,252 | 8/1962 | Noll | 37/103 X |
| 3,184,085 | 5/1965 | Randall et al. | 37/103 X |

FOREIGN PATENT DOCUMENTS

| | | | |
|---|---|---|---|
| 1,304,073 | 7/1961 | France | 37/117.5 |
| 1,305,686 | 10/1961 | Italy | 37/DIG. 3 |
| 99,923 | 3/1962 | Norway | 37/103 |
| 58,954 | 1/1970 | Poland | 37/103 |
| 1,049,308 | 11/1966 | United Kingdom | 37/117.5 |
| 1,244,354 | 9/1971 | United Kingdom | 37/103 |

*Primary Examiner*—E. H. Eickhoff

[57] ABSTRACT

An excavating device is disclosed which is capable of attachment to a conventional hydraulic boom structure having a power-driven winch cable. The device has a bucket pivotably mounted thereon, such that when the device is attached to the boom structure in a first mode, the bucket can be driven by the winch cable as a shovel and when attached to the boom structure in a second mode, the bucket can be driven by the winch cable as a back hoe.

18 Claims, 5 Drawing Figures

EXCAVATOR ATTACHMENT FOR BOOM STRUCTURE

BACKGROUND OF THE INVENTION

1. Field of the Invention

This invention relates to excavating equipment and more particularly to a device which is easily attached to a conventional hydraulic boom structure having a power-driven winch cable to convert the boom structure into either an excavating shovel or back hoe.

2. Description of the Prior Art and Objects

Applicant is unaware of any excavating device which can be quickly and easily attached to a conventional hydraulic boom structure capable of being raised, lowered, extended, retracted and rotated and having a power-driven winch cable to thereby transform the boom structure into, in one mode of attachment of the device, a shovel driven by the winch cable and into, in another mode of attachment of the device, a back hoe driven by the winch cable.

The excavating devices of which applicant is aware are entire machines specifically designed to perform only the function of digging earth away from the machine as a shovel or toward the machine as a back hoe. These specifically designed machines are costly and complex in that most have one or more hydraulic operating pistons and associated linkage mechanisms, hydraulic connecting lines, pumps and control valving for operating the bucket. They are not suitable for use on jobs where only a small amount or occasional shovel or back hoe digging is required due to the substantial monetary investment involved and oftentimes the necessity of having personnel trained specifically in its operation.

It is, therefore, the primary object of the present invention to provide an excavating device which can be easily attached to a conventional hydraulically operated boom structure having a power winch cable to convert said boom structure into an excavating machine.

It is another object of the invention to provide an excavating device which can be attached to a boom structure in two modes: one mode of which converts the boom structure into a shovel and in another mode of which the boom structure is converted into a back hoe.

It is a further object of the invention to provide an excavating device having a digging bucket which relies for its entire operation on the winch cable associated with a boom structure.

It is a still further object of the invention to provide an excavating device which is simple in construction, not expensive to manufacture, and which can be quickly installed on and removed from an ordinary hydraulically operated boom structure having a power winch cable.

Yet another object of the invention is to provide an excavating device which is compact and operates close to the boom structure resulting in greater stability and support.

Other objects of this invention will be apparent from the following description taken in connection with the accompanying drawings wherein.

DETAILED DESCRIPTION OF PREFERRED EMBODIMENT

Figure 1:
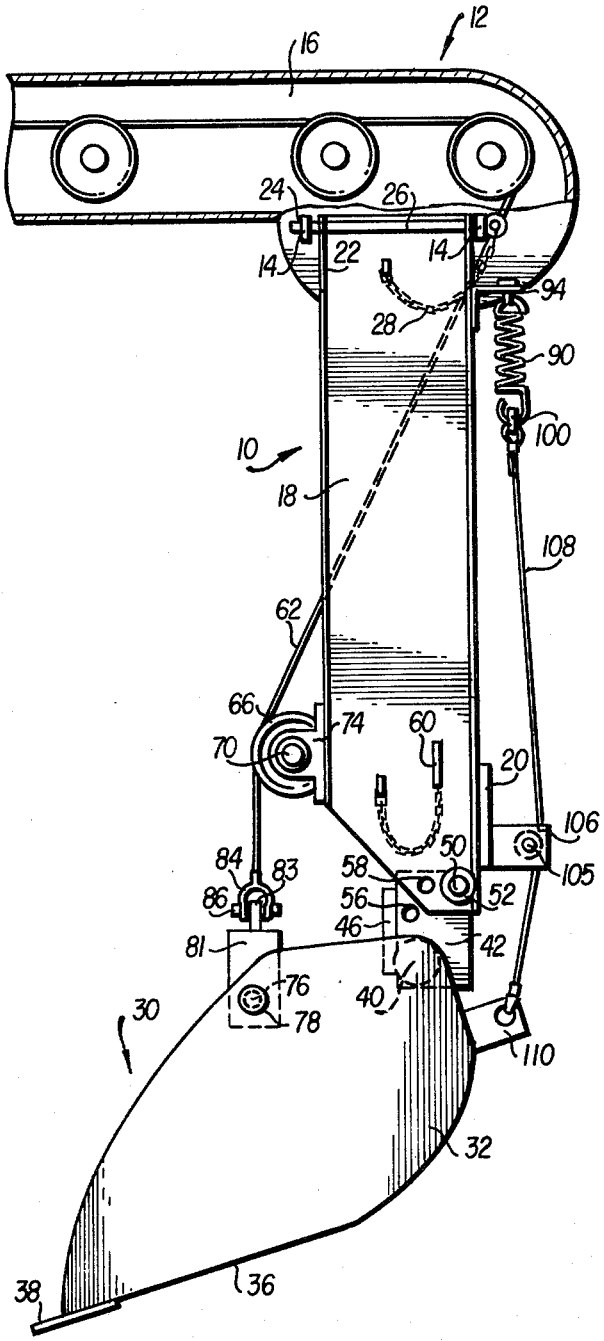
FIG. 1 is a side elevational view of the excavating device of the present invention attached to a hydraulic boom structure to operate as a back hoe.
Figure 3:
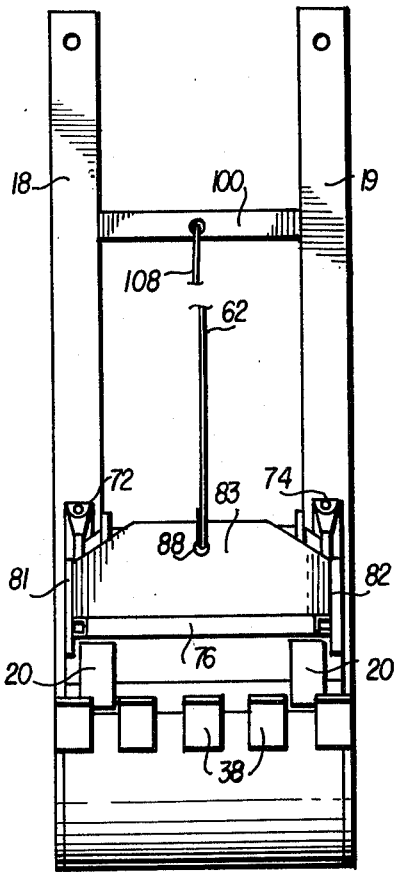
FIG. 3 is an end view of the excavating device as viewed from right to left of FIG. 2.

Referring now to the drawings where like characters of reference refer to identical parts in each of the several views, numeral 10 indicates generally the excavating device of the present invention. The excavating device 10 can be attached to any conventional, hydraulically operated boom or derrick 12 capable of being raised, lowered, extended, retracted, and preferably also rotated. The boom 12 is also of the general type having an electrically or hydraulically operated winch cable.

The excavating device 10 is removably attached to the boom 12 by means of a pair of parallel, spaced apart mounting elements or ears 14, which are welded to opposite sides 16 of boom 12. The excavating device 10 comprises a pair of substantially U-shaped channel members or bucket arms, 18, 19, which are maintained in spaced-apart parallel relationship to each other by means of a cross-plate 20 welded to the channel members 18, 19 at one end thereof. The other ends of channel members 18, 19 have holes 22 formed therethrough which, when in position between ears 14, align with holes 24 formed in the ears 14. A pin 26 secured by a chain 28 is attached to each channel member 18, 19 for retaining the channel members 18, 19, in position relative to the ears 14, and substantially perpendicular to boom 12, when the pin 26 is positioned in the holes 22, 24 as shown in FIGS. 1 and 2.

A bucket 30 is provided having side plates 32, 34, a bottom plate 36, and digging teeth 38 secured to the bottom plate 36 at one end thereof. A tubular member 40 is positioned within the bucket 30 and welded at its ends to side plates 32, 34. A pair of support plates 42, 44 are secured to tubular member 40 in spaced apart parallel relationship to each other and are reinforced in their position by means of additional plates 46, 48 respectively, which are also welded to plates 42, 44, as well as to tubular member 40. Bucket 30 is pivotably secured to channel members 18, 19 by means of a shaft 50 extending between and welded to support plates 42, 44. The shaft 50 is journaled in bushings 52, 54, which bushings are also welded to channel members 18, 19. The support plates 42, 44 have holes 56 formed therethrough which align with a corresponding hole 58 formed in channel members 18, 19 when the bucket 30 is raised to a position substantially perpendicular to channel members 18, 19. The bucket 30 can be maintained in this perpendicular position by means of a pin 60 placed in the aligned holes 56, 58. Locking the bucket 30 in this manner prevents the bucket from swinging freely during transport which may result in damage or severing of associated cables to be presently described.

Figure 2:
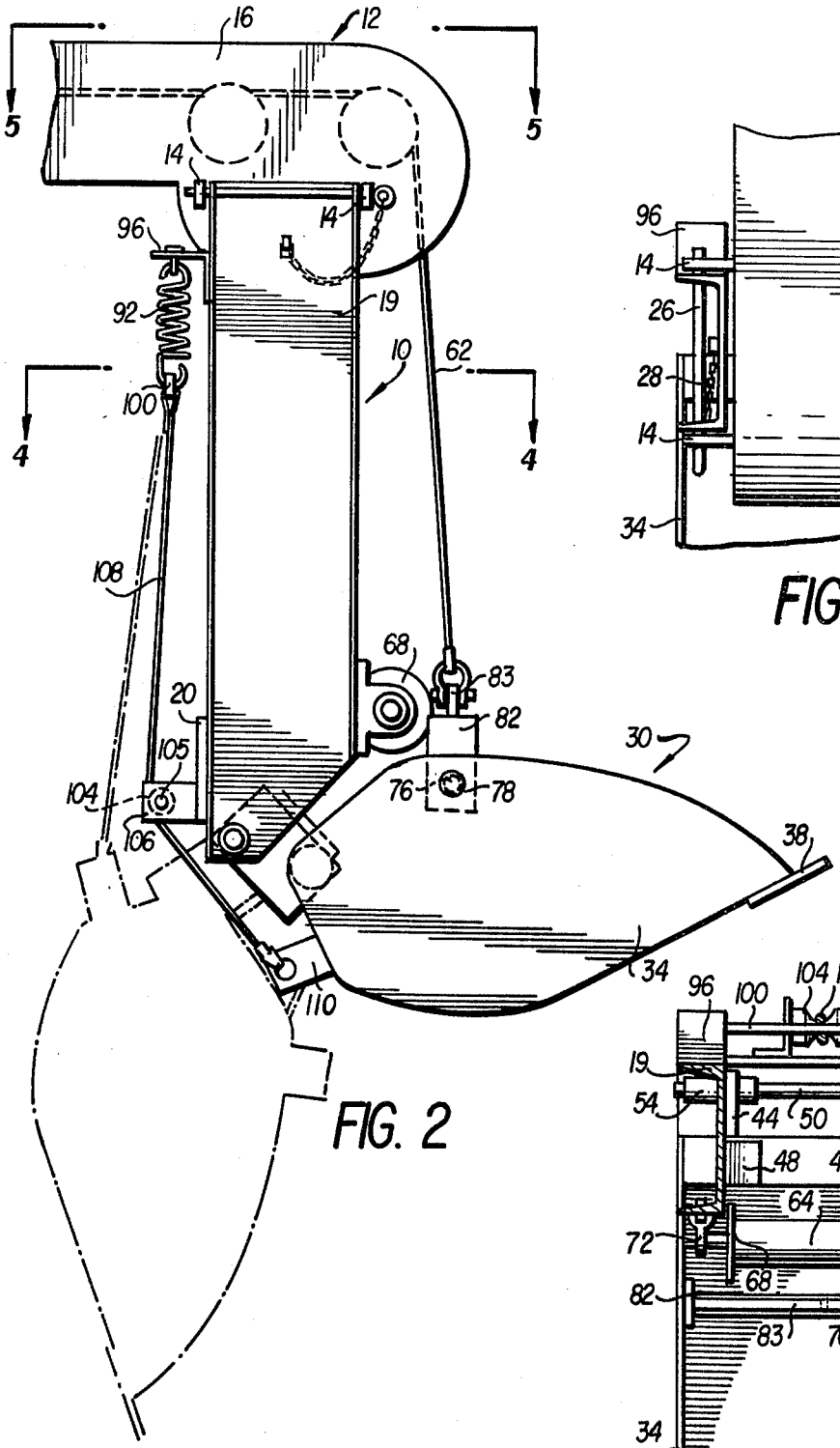
FIG. 2 is a side elevational view of the excavating device of the present invention attached to a hydraulic boom structure to operate as a shovel.
Figure 5:
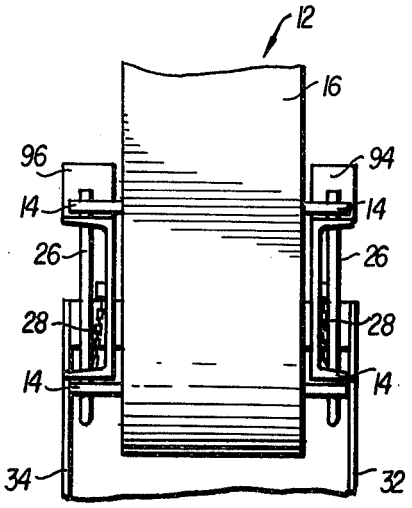
FIG. 5 is a top view of the excavating device taken along the lines 5—5 of FIG. 2.
Figure 4:
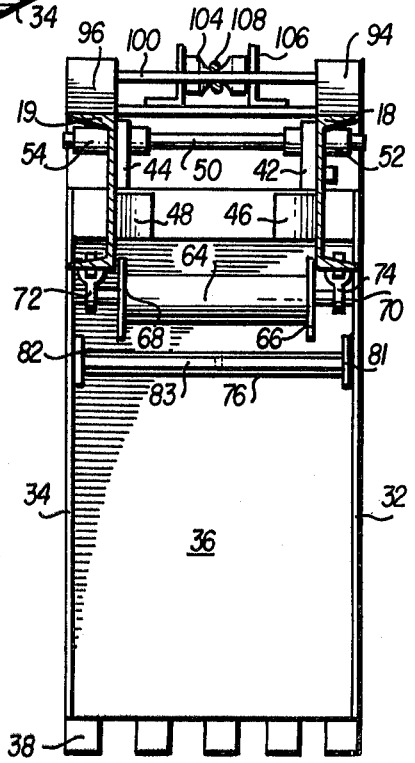
FIG. 4 is a top view of the excavating device taken along the lines 4—4 of FIG. 2.

The boom 12 has a winch cable 62 associated with it which is used to raise the bucket 30 either in its back hoe mode of attachment and operation shown in FIG. 1, or its shovel mode of attachment and operation shown in FIG. 2. When the back hoe mode is being used, a roller 64 is provided as a guide to the cable 62. The roller 64 has two circular shaped end plates 66, 68 which are welded to the roller 64 to form a spool. A shaft 70 is provided co-axial with the roller 64 and welded to the end plates 66, 68. The ends of the shaft 70 ae journaled in pillar bearings 72, 74, bolted to channel members 18, 19. When the bucket 30 is attached in its shovel mode of operation as shown in FIG. 2, the winch cable 62 will ride on roller 64 as the bucket 30 is rotated to its open position, which is when it is substantially in alignment with channel members 18, 19.

The bucket 30 also has a shaft 76 extending between the side plates 32, 34, which is journaled in bushings 78, 80. The bushings 78, 80 are welded to the side plates 32, 34 to enable the shaft 70 to rotate freely with respect thereto. A pair of spaced apart, parallel side plates 81, 82 are welded to the shaft 76 and are in turn themselves welded to a cross plate 83. The cross plate 83 is also welded along its bottom edge to shaft 76. The winch cable 62 has a clevis 84 on one end thereof for attaching the cable 62 to the cross plate 83. This attachment is made by means of a clevis pin 86 which is positioned through hole 88 located at the midpoint of cross plate 83.

As can readily be seen, to effect digging in the back hoe mode as shown in FIG. 1, the bucket 30 is raised by the winch cable 62 to the desired angle relative to the horizontal and the boom 12 is retracted. Further retraction of the winch cable 62 will position the bucket 30 substantially perpendicular to the channel members 18, 19, and insure that the contents remain in the bucket as it is moved to the desired dumping location. Upon reaching the dumping location, the winch cable 62 is disengaged from its drive (not shown) and the bucket 30 is permitted to move freely. To insure that the bucket 30 rotates to its full dumping position, i.e., substantially in alignment with channel members 18, 19, a pair of springs 90, 92 are provided. One end of each spring 90, 92 is connected to an L-shaped bracket 94, 96 respectively, by means of an adjustment bolt 98. The brackets 94, 96, in turn are bolted or welded to channel members 18, 19. The other end of the springs 90, 92 are secured to the ends of a cross bar 100 which has a hole 102 formed through the midpoint thereof. A guide roller 104 is rotatably mounted on a shaft 105 secured between L-shaped flanges 106. The flanges 106 in turn are bolted to cross plate 20 secured to channel members 18, 19, as aforementioned. A cable 108 is secured at one of its ends through hole 102 of cross bar 100 and is passed over guide roller 104. The other end of cable 108 is secured to a bracket 110 welded to the outside back of bucket 30 substantially as shown in FIG. 1. In addition to moving and holding the bucket 30 in its open or dumping position, springs 90, 92 help to avoid back and forth swinging of the bucket as it is being extended and retracted.

Applicant has thus disclosed his novel excavator attachment which can easily be attached to any boom structure of the aforementioned type and which, in one mode of operation, it is back hoe and in another mode of operation it is a shovel. The foregoing disclosure, however, is to be considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the appended claims.

What I claim is:

1. An excavating device capable of being reversably attached to the end of any conventional machine mounted boom structure having a power driven winch cable associated therewith, said device comprising:

a. first and second sets of spaced appart mounting elements, one set of each of said elements being capable of being secured to opposite sides of the end of said boom structure, b. a pair of spaced apart, downwardly depending bucket arms, one end of each of said arms being detachably secured between one set of said mounting elements, and c. bucket means pivotably mounted between the other end of said pair of spaced apart bucket arms, said bucket means being operatively connected to said winch cable such that when said bucket arms are attached to said mounting elements in a first mode, said bucket means is capable of digging away from said machine and when said bucket arms are attached to said mounting elements in a second mode, said bucket means is capable of digging toward said machine.

2. An excavating device as set forth in claim 1 wherein each set of said mounting elements and each of said bucket arms having apertures therethrough and each of said bucket arms is secured between a set of said mounting elements by means of a removably mounted pin extending through said apertures in said mounting elements and said arms.

3. An excavating device as set forth in claim 2 further comprising spring means attached to said bucket arms, said spring means having cable means attached thereto and to said bucket means for rotating said bucket means to a dumping position.

4. An excavating device as set forth in claim 3 wherein said spring means further comprises first and second coil springs, one end of each of said coil springs being secured to one of said bucket arms, the other end of each of said coil springs being secured to a cross bar common to each of said coil springs and wherein said cable means is attched to said cross bar and to said bucket means.

5. An excavating device as set forth in claim 3 further comprising roller means mounted between said bucket arms adjacent to said cable means for guiding said cable means.

6. An excavating device as set forth in claim 1 wherein said bucket means has parallel side members, and said winch cable is connected to a side plate pivotably mounted between said side members.

7. An excavating device as set forth in claim 1 wherein said bucket arms have spool means rotatably mounted thereon and said winch cable extends over said spool means to be guided thereby.

8. An excavating device as set forth in claim 7 wherein means are provided for maintaining said bucket means in a position substantially perpendicular to said bucket arms.

9. An excavating device as set forth in claim 1 wherein said bucket means is pivotably mounted on said bucket arms by means of a shaft extending between said bucket arms, said shaft being secured to a pair of parallel, spaced apart plates secured to said bucket means.

10. In combination with a conventional machine mounted boom structure having a power driven winch cable associated therewith, a first and second set of spaced apart mounting elements, one set of each of said elements being secured to opposite sides of the end of said boom structure, a pair of spaced apart, downwardly depending bucket arms, one end of each of said arms being detachably secured between one set of said mounting elements, and bucket means pivotably mounted between the other end of said pair of spaced apart bucket arms, said bucket being operatively connected to said winch cable, such that when said bucket arms are attached to said mounting elements in a first mode, said bucket is capable of digging away from said machine and when said bucket arms are attached to said mounting elements in a second mode, said bucket is capable of digging toward said machine.

11. The combination set forth in claim 10 wherein each set of said mounting elements and each of said bucket arms have apertures therethrough and each of said bucket arms is secured between a set of said mounting elements by means of a removably mounted pin extending through said apertures in said mounting elements and said arms.

12. The combination as set forth in claim 11 further comprising spring means attached to said bucket arms, said spring means having cable means attached thereto and to said bucket means for rotating said bucket means to a dumping position.

13. The combination as set forth in claim 12 wherein said spring means further comprises first and second coil springs, one end of each of said coil springs being secured to one of said bucket arms, the other end of each of said coil springs being secured to a cross bar common to each of said coil springs and wherein said cable means is attached to said cross bar and to said bucket means.

14. The combination as set forth in claim 12 further comprising roller means mounted between said bucket arms adjacent to said cable means for guiding said cable means.

15. The combination as set forth in claim 10 wherein said bucket means has parallel side members and said winch cable is connected to a side plate pivotably mounted between said side members.

16. The combination as set forth in claim 10 wherein said bucket arms have spool means rotatably mounted thereon, and said winch cable extends over said spool means to be guided thereby.

17. The combination as set forth in claim 10 wherein means are provided for maintaining said bucket means in a position substantially perpendicular to said bucket means.

18. The combination as set forth in claim 10 wherein said bucket means is pivotably mounted on said bucket arms by means of a shaft extending between said bucket arms, said shaft being secured to a pair of parallel, spaced apart plates secured to said bucket means.

* * * * *